US009026016B2

(12) United States Patent
Nakaegawa

(10) Patent No.: US 9,026,016 B2
(45) Date of Patent: May 5, 2015

(54) IMAGE FORMING APPARATUS

(75) Inventor: Tohru Nakaegawa, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 47 days.

(21) Appl. No.: 13/568,488

(22) Filed: Aug. 7, 2012

(65) Prior Publication Data

US 2013/0039679 A1 Feb. 14, 2013

(30) Foreign Application Priority Data

Aug. 9, 2011 (JP) ..... 2011-173527

(51) Int. Cl.
*G03G 15/16* (2006.01)

(52) U.S. Cl.
CPC .... *G03G 15/1615* (2013.01); *G03G 2215/0132* (2013.01); *G03G 2215/1661* (2013.01)

(58) Field of Classification Search
CPC ..... G03G 15/16; G03G 15/00; G03G 15/20
USPC ..... 399/297, 98, 99, 101, 107, 121, 123, 399/306, 308, 165, 302, 303, 313, 34, 3, 399/358
See application file for complete search history.

(56) References Cited

U.S. PATENT DOCUMENTS

| | | | | |
|---|---|---|---|---|
| 6,128,460 | A * | 10/2000 | Ito et al. | 399/303 |
| 2009/0245895 | A1 * | 10/2009 | Miyamoto et al. | 399/308 |
| 2012/0006215 | A1 * | 1/2012 | DeJong et al. | 101/481 |

FOREIGN PATENT DOCUMENTS

| | | | |
|---|---|---|---|
| JP | 5-11647 | A | 1/1993 |
| JP | 11-272087 | A | 10/1999 |
| JP | 2005037521 | A * | 2/2005 |

* cited by examiner

*Primary Examiner* — Walter L Lindsay, Jr.
*Assistant Examiner* — Matthew Miller
(74) *Attorney, Agent, or Firm* — Fitzpatrick, Cella, Harper & Scinto

(57) ABSTRACT

An image forming apparatus includes a photosensitive drum for bearing a toner image, a rotatable endless belt provided so that its outer surface opposes the drum, and a rigid transfer roller, provided so as to contact an inner surface of the belt, for transferring the toner image from the drum onto the belt or a recording material conveyed by the belt. A coefficient of static friction of a surface of the transfer roller is smaller than that of the inner surface of the belt. In addition, a stretching roller is provided so as to contact the inner peripheral surface of the belt for stretching the belt, with a coefficient of static friction of a surface of the stretching roller being larger than that of the inner peripheral surface of the belt. A cleaning member cleans the surface of the stretching roller.

7 Claims, 6 Drawing Sheets

IMAGE FORMING APPARATUS

FIELD OF THE INVENTION AND RELATED ART

The present invention relates to an image forming apparatus such as a copying machine, a printer, a facsimile machine and a multi-function machine of these machines. Particularly, the present invention relates to a structure in which a transfer roller for transferring a toner image from an image bearing member onto an intermediary transfer belt or a recording material conveyed by a recording material conveyance belt is a rigid member.

In recent years, a metal roller has been widely used as the transfer roller for transferring the toner image, formed on the image bearing member, onto the intermediary transfer belt or the recording material conveyed by the recording material conveyance belt. The metal roller is such that the roller itself is an electroconductive member and therefore there is no resistance fluctuation due to environmental fluctuation or durability fluctuation. For this reason, different from an elastic roller having a rubber layer, there is no need to effect high-voltage control such as ATVC (active transfer voltage control). Further, the metal roller itself is inexpensive, so that a simpler transfer device can be constituted.

Incidentally, in the case where image formation is effected by using the toner image, a surface of the transfer roller can be contaminated by scattering toner or the like. As described in Japanese Laid-Open Patent Application (JP-A) Hei 11-272087, a structure in which a cleaning roller is contacted to the transfer roller and a cleaning bias is applied to the cleaning roller to clean the transfer roller surface has been known.

Further, as described in JP-A Hei 5-11647, a structure in which instead of using the cleaning roller, a contaminant is moved back to a photosensitive member by applying a cleaning bias of an opposite polarity to that of a bias applied to the transfer roller.

In the case where a rigid roller such as the metal roller is used as the transfer roller, the rigid roller has no rubber layer and therefore there is a possibility that a foreign matter such as scattering toner is deposited and agglomerated on the transfer roller surface by long-term use. Further, when the foreign matter such as the toner is agglomerated on the transfer roller surface in such a manner, at a contact surface between the transfer roller surface and the intermediary transfer belt or the recording material conveyance belt, a local gap or a local resistance fluctuation by the foreign matter can occur. When such a local gap or resistance fluctuation occurs between the transfer roller and the belt, there is a possibility that an image defect such as white dropout is generated.

Therefore, as in the structures described in JP-A Hei 11-272087 and JP-A Hei 5-11647, it would be considered that the toner deposited on the transfer roller is electrostatically moved to the cleaning roller or the photosensitive member. However, the toner deposited on the transfer roller by the toner scattering or the like can be charged to an opposite polarity to a normal charge polarity of the toner or can be little charged. For this reason, it is difficult to electrostatically move all of the toner (particle) onto the cleaning roller or the photosensitive member, so that a sufficient cleaning effect cannot be obtained.

SUMMARY OF THE INVENTION

The present invention has been accomplished in view of the above-described circumstances. A principal object of the present invention is to provide an image forming apparatus capable of reducing a degree of image defect generated by a foreign matter deposited on a transfer roller surface in a structure using a rigid roller as the transfer roller.

According to an aspect of the present invention, there is provided an image forming apparatus comprising: a photosensitive drum for bearing a toner image; a rotatable endless belt provided so that its outer peripheral surface opposes the photosensitive drum; a rigid transfer roller, provided so as to contact an inner peripheral surface of the belt, for transferring the toner image from the photosensitive drum onto the belt or a recording material conveyed by the belt by being supplied with a transfer bias, wherein a coefficient of static friction of a surface of the transfer roller contacting the inner peripheral surface of the belt is smaller than a coefficient of static friction of the inner peripheral surface of the belt; a stretching roller, provided so as to contact the inner peripheral surface of the belt, for stretching the belt, wherein a coefficient of static friction of a surface of the stretching roller contacting the inner peripheral surface of the belt is larger than the coefficient of static friction of the inner peripheral surface of the belt; and a cleaning member for cleaning the surface of the stretching roller.

According to the present invention, the coefficient of static friction is larger at the stretching roller surface than at the inner peripheral surface of the belt and therefore the foreign matter such as the toner deposited on the inner peripheral surface of the belt is transferred onto the stretching roller surface, and then the stretching roller surface is cleaned by the cleaning member. For this reason, the foreign matter is not readily left on the inner peripheral surface of the belt, so that the foreign matter is not readily deposited on the surface of the transfer roller contacting the inner peripheral surface of the belt. As a result, it is possible to reduce the degree of the image defect generated by the foreign matter deposited on the surface of the transfer roller.

These and other objects, features and advantages of the present invention will become more apparent upon a consideration of the following description of the preferred embodiments of the present invention taken in conjunction with the accompanying drawings.

Figure 4:
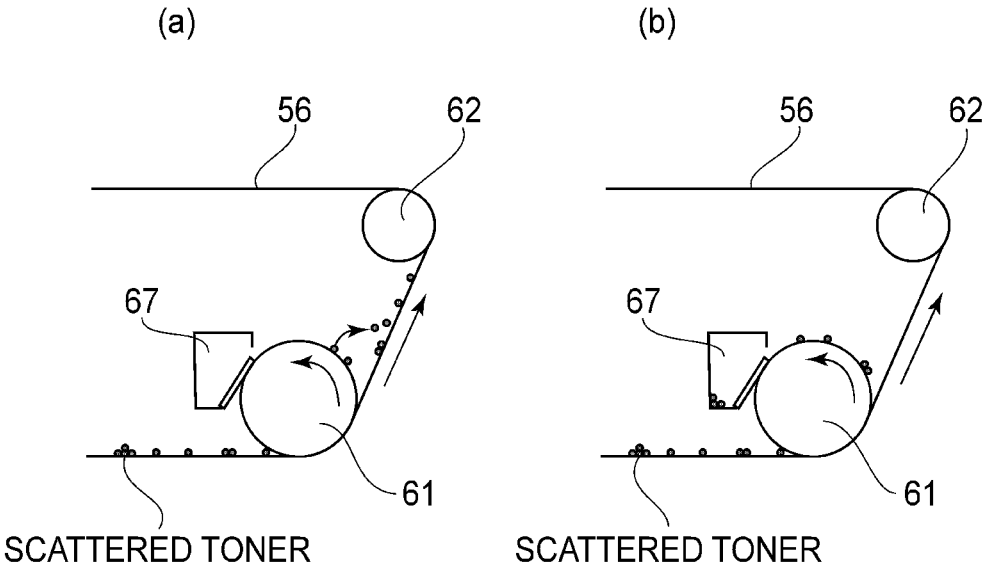

Part (a) of FIG. 4 is a schematic view showing a toner transfer state in the case where a coefficient of static friction is smaller at a surface of an idler roller than at an inner peripheral surface of an intermediary transfer belt, and (b) of FIG. 4 is a schematic view showing a toner transfer state in the case where the coefficient of static friction is larger at the surface of the idler roller than at the inner peripheral surface of the intermediary transfer belt.

Figure 5:
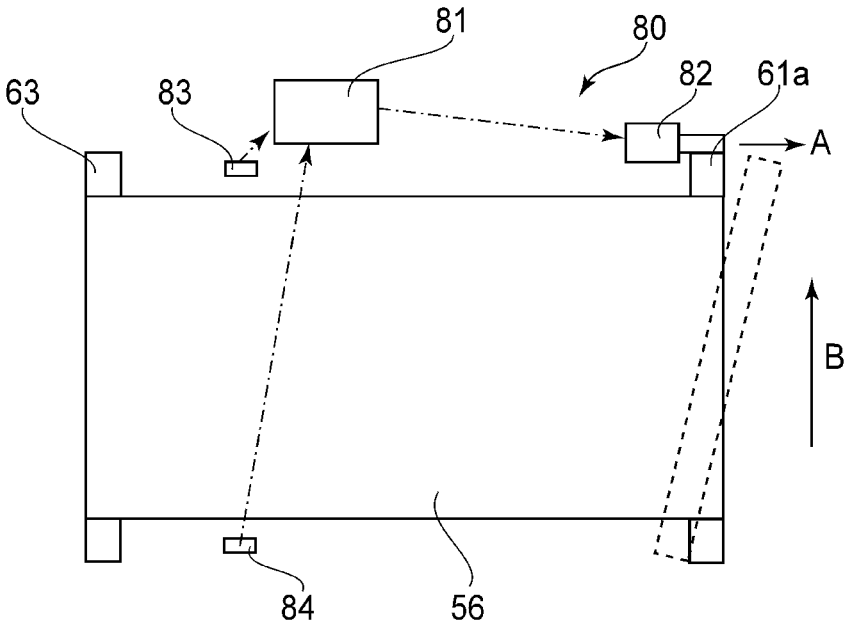

FIG. 5 is a schematic view for illustrating lateral deviation control of a steering roller in Second Embodiment of the present invention.

Figure 6:
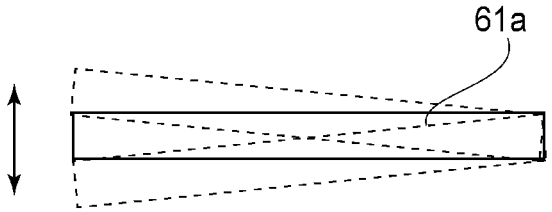

FIG. 6 is a schematic view for illustrating inclination of the steering roller in the lateral deviation control.

Figure 7:
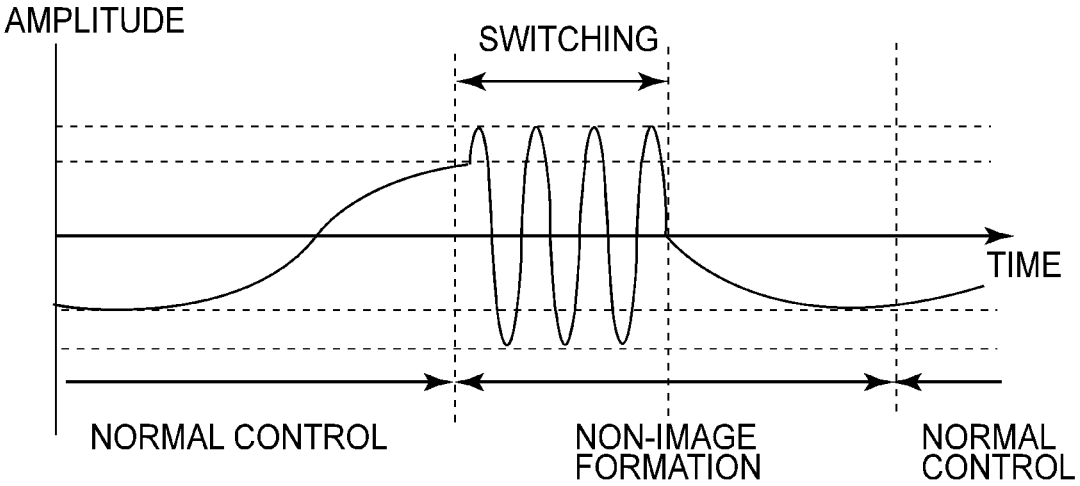

FIG. 7 is a schematic view showing a period and an amplitude in the lateral deviation control during image formation and during non-image formation.

Figure 8:
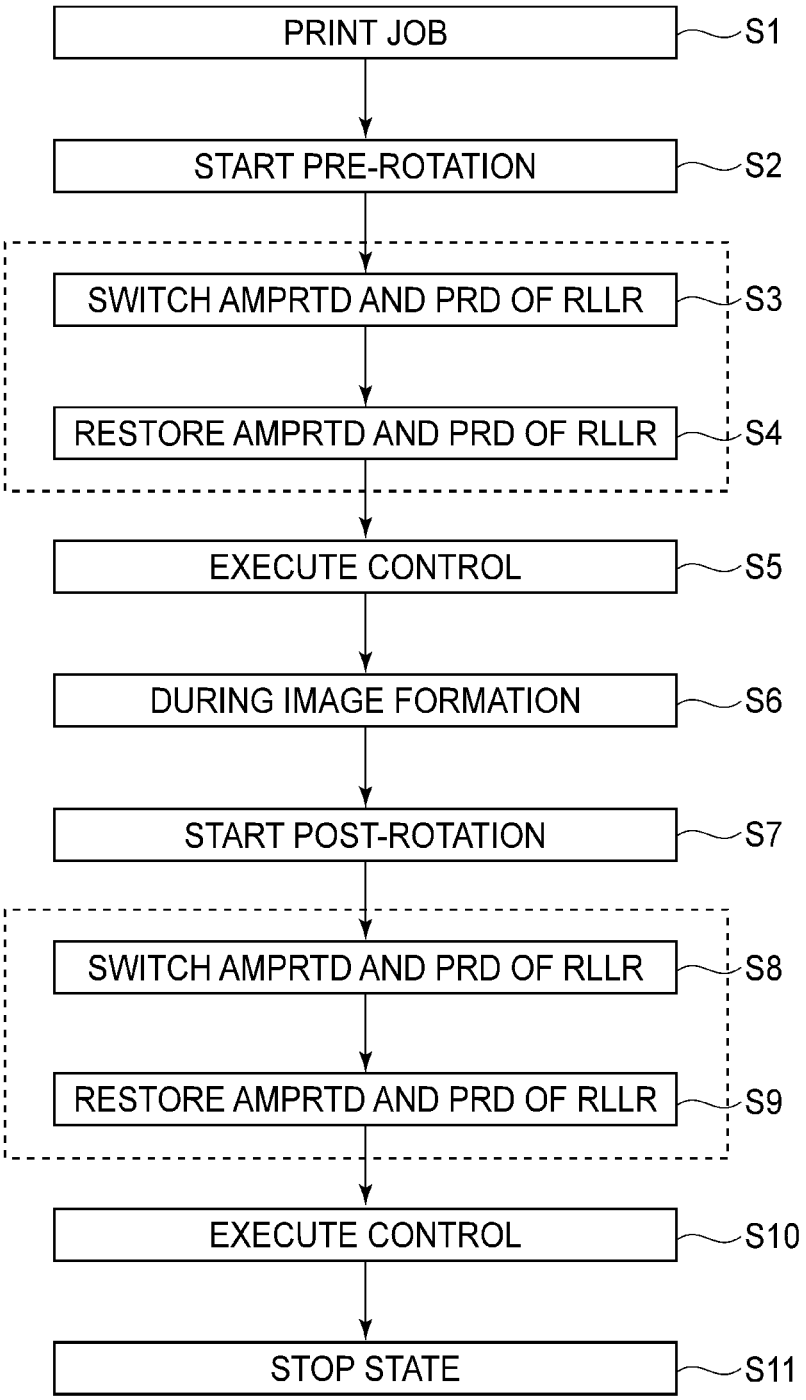

FIG. 8 is a flow chart of lateral deviation control in a Second Embodiment.

Figure 9:
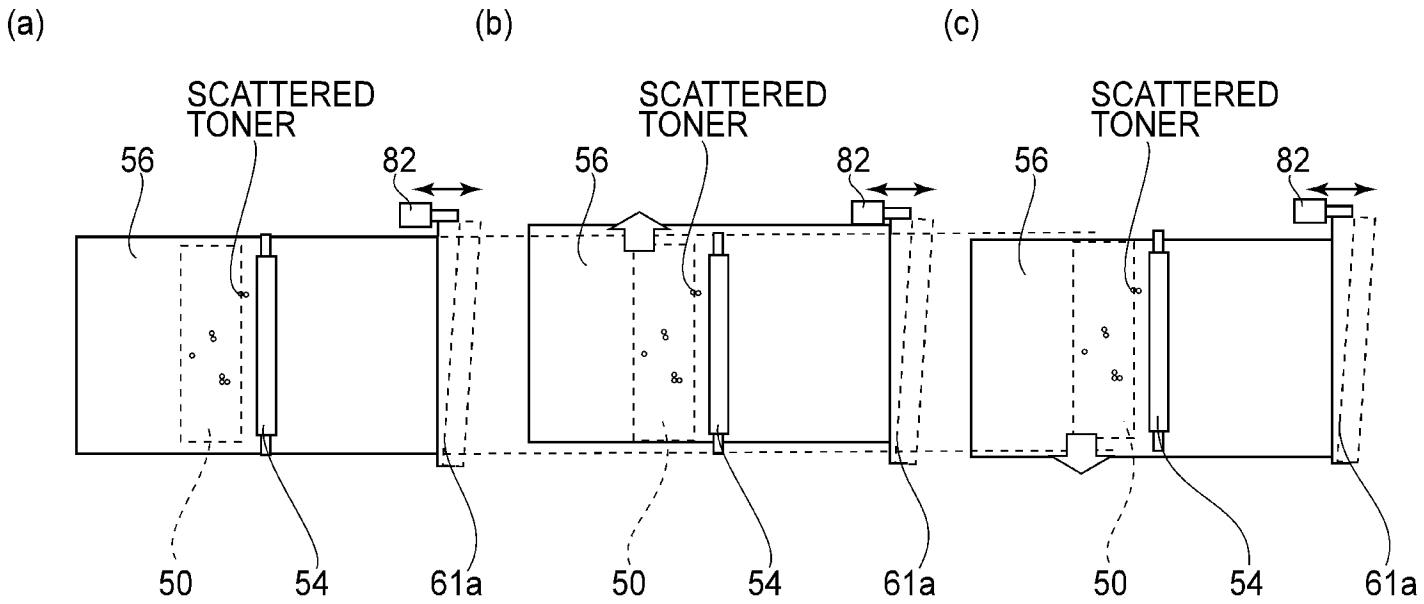

Parts (a), (b) and (c) of FIG. 9 are schematic views for illustrating an operation of an intermediary transfer belt in the lateral deviation control during non-image formation.

DESCRIPTION OF THE PREFERRED EMBODIMENTS

Embodiments of the present invention will be described with reference to the drawings.

First Embodiment

A First Embodiment of the present invention will be described with reference to FIGS. 1 to 4. Incidentally, in FIGS. 1 to 4, members or portions represented by the same reference numerals or symbols have the same constitutions and functions and will be appropriately omitted from redundant description.

[Image Forming Apparatus]

First, with reference to FIG. 1, a general structure of an image forming apparatus according to the present invention will be described. The image forming apparatus is a so-called tandem type image forming apparatus of an intermediary transfer type and includes a plurality of image forming stations Pa, Pb, Pc and Pd where toner images as respective color components are formed by an electrophotographic process. In this embodiment, these image forming stations are provided in the order of those for yellow (Y), magenta (M), cyan (C) and black (K) from an upstream side with respect to a rotational direction (arrow β direction) of an intermediary transfer belt 56.

In this embodiment, the image forming stations rotate in an arrow α direction and include photosensitive drums 50*a*, 50*b*, 50*c* and 50*d*, respectively, as an image bearing member for bearing a toner image. Around the photosensitive drums 50*a*, 50*b*, 50*c* and 50*d*, devices for electrophotography are successively provided. That is, with respect to the rotational direction of the photosensitive drums, primary chargers 51*a*, 51*b*, 51*c* and 51*d*, exposure devices 52*a*, 52*b*, 52*c* and 52*d*, developing devices 53*a*, 53*b*, 53*c* and 53*d*, and cleaning devices 55*a*, 55*b*, 55*c* and 55*d* are disposed. Further, the photosensitive drums 50*a*, 50*b*, 50*c* and 50*d* are disposed along the rotational direction of the intermediary transfer belt 56. In the following, the respective image forming stations have the substantially same bias constitution and therefore constituent elements therefor will be described by omitting suffixes of their reference numerals or symbols.

The primary charger 51 electrically charges a surface of the photosensitive drum 50 to a predetermined potential. The exposure device 52 exposes to light the surface of the photosensitive drum 50 charged to the predetermined potential, so that an electrostatic latent image is formed on the photosensitive drum surface. The developing device 53 accommodates an associated color component toner and develops (visualizes) the electrostatic latent image, formed on the surface of the photosensitive drum 50, into a toner image with the toner. The toner image formed on the photosensitive drum 50 is successively primary-transferred onto the intermediary transfer belt 56. The cleaning device 55 removes a residual toner on the photosensitive drum 50.

In order to primary-transfer the respective toner images from the photosensitive drums 50*a*, 50*b*, 50*c* and 50*d* onto the intermediary transfer belt 56, primary transfer rollers 54*a*, 54*b*, 54*c* and 54*d* are provided at positions where they oppose the photosensitive drums 50*a*, 50*b*, 50*c* and 50*d*, respectively, via the intermediary transfer belt 56. These primary transfer rollers 54 are disposed so as to contact an inner peripheral surface of the intermediary transfer belt 56 at their outer peripheral surfaces. Further, by application of a predetermined transfer bias, the respective color component toner images formed on the photosensitive drums in the image forming stations are successively primary-transferred superposedly onto the intermediary transfer belt 56 at primary transfer portions T1*a*, T1*b*, T1*c* and T1*d*.

The superposed toner images transferred on the intermediary transfer belt 56 are collectively transferred (secondary-transferred) onto a recording material P at a secondary transfer portion T2. The secondary transfer portion T2 is constituted by a secondary transfer outer roller 64 provided in a toner image carrying surface side of the intermediary transfer belt 56 and by the intermediary transfer belt 56 inside of which a secondary transfer inner roller 62 opposes the secondary transfer outer roller 64 via the intermediary transfer belt 56. By applying a predetermined transfer bias to the secondary transfer outer roller 64, the superposed toner images carried on the intermediary transfer belt 56 are transferred onto the recording material P.

Incidentally, the secondary transfer inner roller 62 is formed of, e.g., EPDM (Ethylene Polypropylene Diene Monomer) rubber in a roller diameter of 20 mm and in a rubber thickness of 0.5 mm, and a hardness thereof is set at, e.g., 700 degrees (Asker C hardness). On the other hand, the secondary transfer outer roller 64 is constituted by a core metal and an elastic layer formed of, e.g., NBR (Nitrile Butadiene Rubber) rubber or EPDM rubber in a roller diameter of 24 mm. To the secondary transfer outer roller 64, a high-voltage source is connected, and an applied bias is variable.

The recording material P is fed from an unshown cassette or tray, in which sheets of the recording material P are accommodated, with predetermined timing by a pick-up roller. The recording material P fed by the pick-up roller is conveyed to the secondary transfer portion T2 by registration rollers 66 while being timed to the toner images transferred on the intermediary transfer belt 56.

The toner image transferred on the recording material P is fixed on the recording material P by being heated and pressed by a fixing device A. A residual toner and paper powder on the intermediary transfer belt 56 after the secondary transfer are removed by an intermediary transfer belt cleaning device 65 provided downstream of the secondary transfer portion T2 of the intermediary transfer belt 56. Operations of these devices (portions) are controlled by a controller C.

Here, the intermediary transfer belt 56 as an intermediary transfer member in this embodiment is prepared by containing an antistatic agent such as carbon black in an appropriate amount in various resins such as polyimide and polyamide or in various rubbers. The intermediary transfer belt 56 is formed so that its volume resistivity is $10^8$-$10^{13}$ Ω·cm and is constituted by a film-like endless belt having a thickness of, e.g., about 0.04-0.1 mm. Further, a surface resistivity of the intermediary transfer belt 56 may preferably be $10^8$-$10^{14}$ Ω/square.

The thus-constituted intermediary transfer belt 56 is disposed so that its outer peripheral surface opposes the photosensitive drums 50, and is circulated and driven (rotated) at a predetermined speed in a state in which the intermediary transfer belt 56 is stretched by a plurality of stretching rollers 60, 61, 62 and 63. Specifically, a driving roller 62 also functioning as the secondary transfer inner roller is driven by a motor excellent in providing a constant speed to rotate the intermediary transfer belt 56. Further, idler rollers 60 and 61 support the intermediary transfer belt 56 at both end portions of a lower belt portion along an arrangement direction of the photosensitive drums 50. These rollers 60, 61, 62 and 63 are disposed so as to contact the inner peripheral surface of the intermediary transfer belt 56. Further, these rollers 60, 61, 62 and 63 are a metal roller or a roller provided with a surface rubber layer.

Further, a tension roller 63 applies a certain tension to the intermediary transfer belt 56 and also functions as a correction roller for preventing meandering of the intermediary transfer belt 56. Incidentally, a belt tension applied to the tension roller 63 is set at about 3-12 kgf (approximately 30-120 N).

Further, in this embodiment, a cleaning member 67 for cleaning the surface of the idler roller 61 is provided downstream of the primary transfer rollers 54 with respect to the rotational direction of the intermediary transfer belt 56. The cleaning member 67 removes and collects a foreign matter such as the toner or the like deposited on the surface of the idler roller 61 by bringing a cleaning blade into contact to the surface of the idler roller 61. Incidentally, the cleaning member 67 may be, in addition to the member using the cleaning blade, constituted by a cleaning brush. The cleaning member 67 may have a constitution for electrostatically remove the foreign matter but may preferably have a constitution in which the cleaning member 61 is contacted to the surface of the idler roller 61 to mechanically remove the foreign matter deposited on the surface of the idler roller 61.

Further, each primary transfer roller 54 is a rigid roller and is constituted by a metal roller of steel grade SUM or SUS in material. Further, each primary transfer roller 54 is constituted so that a voltage of an opposite polarity to the toner charge polarity is applied to the primary transfer roller 54. As a result, the toner images on the respective photosensitive drums 50 are successively electrostatically attracted to the intermediary transfer belt 56, so that the superposed toner images are formed on the intermediary transfer belt 56. Incidentally, the metal roller has a straight shape with respect to a thrust direction and has a roller diameter of about 10 mm. As the rigid roller used as the primary transfer roller 54 in this embodiment, in addition to the metal roller having a metal surface, e.g., a roller which is prepared by forming a thin rubber layer on the surface of the metal roller and which can be regarded as a substantially rigid member.

[Primary Transfer Portion]

Next, a constitution of the predetermined transfer portion in this embodiment will be described with reference to FIGS. 2 and 3 in addition to FIG. 1. In this embodiment, as described above, as the primary transfer roller 54, the metal roller which is the rigid roller is used. For this reason, as shown in FIG. 1, each of the respective primary transfer rollers 54 is shifted and disposed downstream of the photosensitive drum 50 with respect to the rotational direction of the intermediary transfer belt 56. This will be described below.

Figure 2:
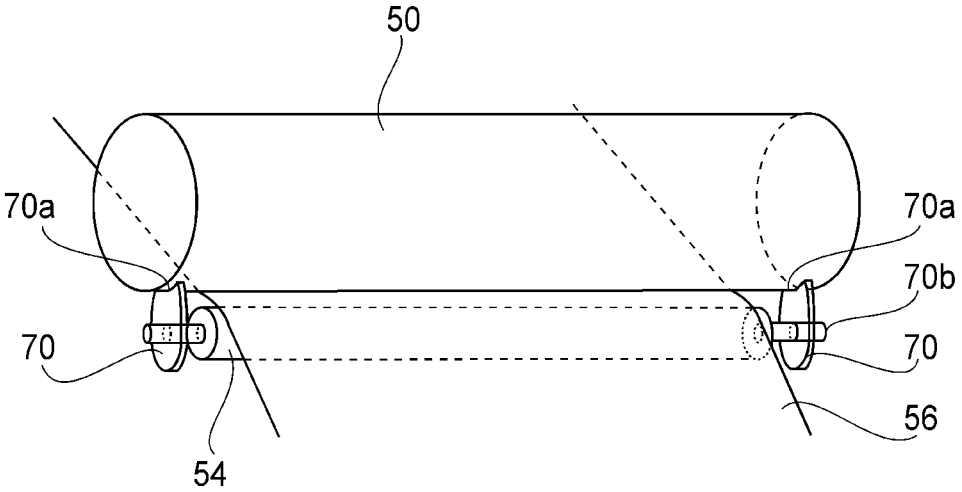
FIG. 2 is a perspective view showing a positioning constitution of a primary transfer roller relative to a photosensitive drum.
Figure 3:
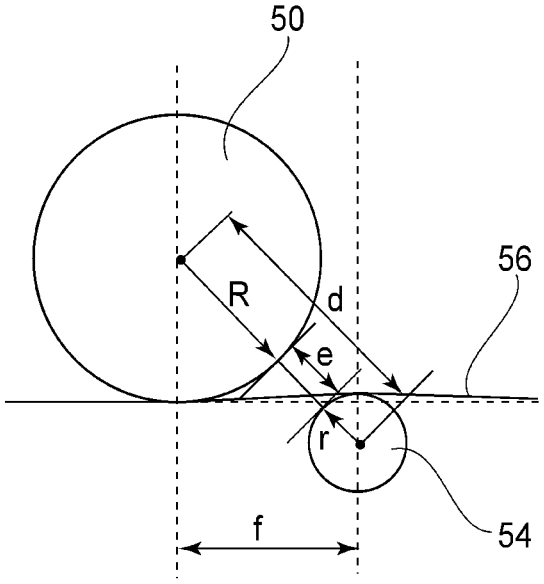
FIG. 3 is a schematic view showing a primary transfer portion in the First Embodiment.

First, as shown in FIG. 2, by employing a constitution in which bearings 70 for rotatably supporting the primary transfer roller 54 are abutted against both axial end portions, of the photosensitive drum 50, where image formation is not effected, a distance between the surfaces of the photosensitive drum 50 and the primary transfer roller 54 is set. That is, the bearings 70 are disposed at unshown fixed portions of the image forming apparatus so that they can be moved toward and away from the photosensitive drum 50, and are urged toward the photosensitive drum 50. Further, the bearings 70 support both axial end portions of a rotation shaft **70*b* of the primary transfer roller 54 at positions located outside the intermediary transfer belt 56 with respect to a widthwise direction. Further, the bearings 70 are contacted to the outer peripheral surface of the photosensitive drum 50 at the both axial end portions of the photosensitive drum 50 while interposing the intermediary transfer belt 56 therebetween, so that the primary transfer roller 54** is positioned.

Each bearing 70 is provided, at its peripheral edge portion toward the photosensitive drum 50, with a cut-away portion **70*a* having a radius of curvature which is the same as or slightly larger than an outer diameter of the outer peripheral surface of the photosensitive drum 50 at the axial end portion. For this reason, the cut-away portion 70*a* contacts the outer peripheral surface of the photosensitive drum 50 at the axial end portion, so that the positioning of the bearing 70** is stably realized.

Further, a position of each primary transfer roller 54 relative to the opposing photosensitive drum 50 with respect to the rotational direction of the intermediary transfer belt 56 is set as follows. First, as shown in FIG. 3, a radius of the opposing photosensitive drum 50 is R, a radius of the primary transfer roller 54 is r, and a center distance between the photosensitive drum 50 and the primary transfer roller 54 is d. Further, the thickness of the intermediary transfer belt 56 is sufficiently smaller than (R+r). In this case, so as to satisfy: $d>(R+r)$, each primary transfer roller 54 is shifted and disposed downstream of the opposing photosensitive drum 50 with respect to the rotational direction of the intermediary transfer belt 56.

For example, a distance (gap) e between the photosensitive drum 50 and the primary transfer roller 54 is set at 0.5-1.5 mm. Further, an offset amount (distance) f in which the primary transfer roller 54 is offset toward a downstream position of the photosensitive drum 54 is set at 4-10 mm. This offset amount is a distance between a perpendicular line drawn from the center axis of the photosensitive drum 50 toward the intermediary transfer belt 56 and the center axis of the primary transfer roller with respect to the rotational axis direction of the intermediary transfer belt 56.

[Relationship of Coefficient of Static Friction Between Inner Peripheral Surface of Intermediary Transfer Belt and Surface of Idler Roller]

A relationship of a coefficient of static friction between the inner peripheral surface (back surface) of the intermediary transfer belt 56 and the surface of the idler roller 61 disposed downstream of the primary transfer portions T1 in this embodiment will be described. In this embodiment, a relationship between the surface of the idler roller 61 and the inner peripheral surface of the intermediary transfer belt 56 is set so that a coefficient of static friction of the idler roller 61 as the stretching roller is larger than a coefficient of static friction of the inner peripheral surface of the intermediary transfer belt 56. That is, when the coefficient of static friction of the inner peripheral surface of the intermediary transfer belt 56 is defined as $\mu 1$ and the coefficient of static friction of the surface of the idler roller 61 is defined as $\mu 2$, $\mu 1<\mu 2$ is satisfied.

In order to set the relationship of the coefficient of static friction between the surface of the idler roller 61 and the inner peripheral surface of the intermediary transfer belt 56 as described above, coating is effected or surface roughness is adjusted. For example, the inner peripheral surface of the intermediary transfer belt 56 is subjected to coating or the like to decrease the surface roughness. On the other hand, the surface of the idler roller 61 is, when the idler roller 61 is the metal roller, subjected to surface treatment (processing) so that the surface roughness thereof is larger than that of the inner peripheral surface of the intermediary transfer belt 56. Further, by providing the surface of the idler roller 61 with a rubber layer, it is also possible to make the coefficient of static friction of the surface of the idler roller 61 larger than that of the inner peripheral surface of the intermediary transfer belt 56.

The surface of the idler roller 61 and the inner peripheral surface of the intermediary transfer belt 56 are not limited to those subjected to the above-described coating or adjustment of the surface roughness but may also be subjected to treatment or adjustment by another method so long as the values of the coefficient of static friction satisfy the above-described relationship. Incidentally, the coefficient of static friction in this embodiment is an average of values measured at a plurality of arbitrary points (e.g., 6 points) on a surface to be subjected to measurement. The coefficient of static friction is measured by using a measuring device ("TRIBOGEAR μs TYPE: 94i", mfd. by SHINTO Science Co., Ltd.), so that the relationship of the coefficient of static friction between the two surfaces is set.

Further, in this embodiment, a relationship of the coefficient of static friction between the inner peripheral surface of the intermediary transfer belt 56 and the surface of each primary transfer roller 54 is also set as follows. That is, the coefficient of static friction of the surface of the primary transfer roller 54 is made larger than the coefficient of static friction of the inner peripheral surface of the intermediary transfer belt 56. The method for setting such a relationship and the measuring method are the same as those in the case of the above-described relationship between the idler roller 61 and the intermediary transfer belt 56.

[Transfer of Foreign Matter]

In this embodiment, as described above, the relationship between the surface of the idler roller 56 and the inner peripheral surface of the intermediary transfer belt 56 and the relationship between the surface of the primary transfer roller 54 and the inner peripheral surface of the intermediary transfer belt 56 are set, so that the foreign matter is transferred as follows. That is, when the foreign matter such as the scattering toner is deposited on the inner peripheral surface of the intermediary transfer belt 56, the foreign matter is carried to the idler roller 61 and is transferred onto the surface of the idler roller 61. Further, the foreign matter such as the scattering toner deposited on the surface of the primary transfer roller 5 is transferred onto the inner peripheral surface of the intermediary transfer belt 56. This foreign matter transferring mechanism will be described.

First, a mechanism for transferring and collecting the foreign matter such as the scattering toner, deposited on the inner peripheral surface of the intermediary transfer belt 56, on the surface of the idler roller 61 will be described with reference to (a) and (b) of FIG. 4. Parts (a) and (b) of FIG. 4 are schematic views each showing a relationship between the intermediary transfer belt 56 and the idler roller 61 immediately after the primary transfer portion. Of these figures, (a) of FIG. 4 shows the case where the coefficient of static friction of the surface of the idler roller 61 is smaller than that of the inner peripheral surface of the intermediary transfer belt 56. Part (b) of FIG. 4 shows the case where the coefficient of static friction of the surface of the idler roller 61 is larger than that of the inner peripheral surface of the intermediary transfer belt 56.

On the inner peripheral surface of the intermediary transfer belt 56, with the use of the image forming apparatus (with time), the foreign matter such as the toner scattered from the developing device 53 can be deposited. Here, each of the toner particles is a fine particle and therefore does not form vertical stripe, resulting from generation of a local gap between the inner peripheral surface of the intermediary transfer belt 56 and the surface of the primary transfer roller 54, causing improper transfer.

However, as shown in (a) of FIG. 4, when the coefficient of static friction of the surface of the idler roller 61 is smaller than that of the inner peripheral surface of the intermediary transfer belt 56, an agglomeration-fixed matter of the foreign matter such as the toner is liable to be conveyed between the inner peripheral surface of the intermediary transfer belt 56 and the surface of the primary transfer roller 54. Specifically, when the coefficient of static friction of the surface of the idler roller 61 is smaller than that of the inner peripheral surface of the intermediary transfer belt 56, the foreign matter deposited on the inner peripheral surface of the intermediary transfer belt 56 is not readily transferred onto the surface of the idler roller 61. Further, even if the foreign matter is transferred, there is a possibility that the foreign matter is detached from the idler roller surface with rotation of the idler roller 61. That is, a foreign matter retaining force is larger on the inner peripheral surface of the intermediary transfer belt 56 than on the surface of the idler roller 61 and therefore the foreign matter between the idler roller 61 and the intermediary transfer belt 56 remains on the intermediary transfer belt 56.

As a result, the foreign matter deposited on the inner peripheral surface of the intermediary transfer belt 56 is conveyed to the downstream rollers while being deposited on the inner peripheral surface without being collected. Then, when the foreign matter such as the toner grows into the agglomeration-fixed matter on the inner peripheral surface of the intermediary transfer belt 56 or on the surface of the primary transfer roller 54, the local gap is generated between the inner peripheral surface of the intermediary transfer belt 56 and the surface of the primary transfer roller 54, so that image defect occurs.

On the other hand, as shown in (b) of FIG. 4, when the coefficient of static friction of the surface of the idler roller 61 is larger than that of the inner peripheral surface of the intermediary transfer belt 56, the foreign matter deposited on the inner peripheral surface of the intermediary transfer belt 56 is easily transferred onto the idler roller surface. This is because a frictional force between the surface of the idler roller 61 and the foreign matter is larger than that between the inner peripheral surface of the intermediary transfer belt 56 and the foreign matter and therefore the foreign matter on the inner peripheral surface of the intermediary transfer belt 56 is easily transferred onto the surface of the idler roller 61.

Thus, by making the coefficient of static friction of the surface of the idler roller 61 larger than that of the inner peripheral surface of the intermediary transfer belt 56, it is possible to transfer the foreign matter deposited on the inner peripheral surface of the intermediary transfer belt 56 onto the surface of the idler roller 61. For this reason, a possibility that the foreign matter such as the scattering toner detected on the inner peripheral surface of the intermediary transfer belt 56 is continuously carried on the inner peripheral surface of the intermediary transfer belt 56 to be conveyed to the positions of the secondary transfer inner roller 62, the tension roller 63 and the primary transfer rollers 54 is reduced.

Similarly, the coefficient of static friction of the inner peripheral surface of the intermediary transfer belt 56 is made larger than that of the surface of the primary transfer roller 54 and therefore the foreign matter such as the scattering toner deposited on the surface of the primary transfer roller 54 is transferred onto the inner peripheral surface of the intermediary transfer belt 56. Alternatively, the foreign matter deposited on the inner peripheral surface of the intermediary transfer belt 56 is not readily transferred onto the surface of the primary transfer roller 54. That is, the foreign matter retaining force is larger on the inner peripheral surface of the intermediary transfer belt 56 than on the surface of the primary transfer roller 54 and therefore the foreign matter between the primary transfer roller 54 and the intermediary transfer belt 56 remains on the intermediary transfer belt 56. For this reason, the foreign matter deposited on the surface of the primary transfer roller 54 is easily transferred onto the inner peripheral surface of the intermediary transfer belt 56, and the foreign matter on the inner peripheral surface of the intermediary transfer belt 56 is not readily transferred onto the surface of the primary transfer roller 54.

Therefore, the foreign matter deposited on the primary transfer roller 54 is transferred onto the inner peripheral surface of the intermediary transfer belt 56 and then the foreign matter deposited on the inner peripheral surface of the intermediary transfer belt 56 is conveyed to the idler roller 61 without being transferred onto the surface of the primary transfer roller 54. Further, as described above, the foreign matter is transferred onto the surface of the idler roller 61.

The foreign matter transferred on the surface of the idler roller 61 is removed and collected by the above-described cleaning member. That is, the foreign matter deposited on the inner peripheral surface of the intermediary transfer belt 56 is transferred onto the surface of the idler roller 61 and then is collected by the cleaning member 61. As a result, it is possible to reduce a degree of growth of the foreign matter such as the toner into the agglomeration-fixed matter on the inner peripheral surface of the intermediary transfer belt 56 or on the surface of the primary transfer roller 54.

Thus, according to this embodiment, the coefficient of static friction is larger at the surface of the idler roller 61 than at the inner peripheral surface of the intermediary transfer belt 56, so that the foreign matter such as the toner deposited on the inner peripheral surface of the intermediary transfer belt 56 is transferred onto the surface of the idler roller 61. Then, the foreign matter is removed by the cleaning member 67. For this reason, the foreign matter is not readily left on the inner peripheral surface of the intermediary transfer belt 56, so that the foreign matter is not readily deposited on the surface of the primary transfer roller 54 contacting the inner peripheral surface of the intermediary transfer belt 56. As a result, the degree of the first defect caused by the foreign matter deposited on the surface of the primary transfer roller 54 can be reduced.

Further, in this embodiment, the intermediary transfer belt 56 is most affected by the toner scattering from the developing device 53 and therefore the relationship of the coefficient of static friction is set as described above with respect to the idler roller 61, located downstream of the primary transfer portion, about which the intermediary transfer belt 56 is wound with a large winding (contact) angle. For this reason, the foreign matter such as the scattering toner can be collected more efficiently, so that the occurrence of the image defect is easily reduced.

Further, in this embodiment, the coefficient of static friction of the inner peripheral surface of the intermediary transfer belt 56 is made larger than that of the surface of the primary transfer roller 54 and therefore the foreign matter such as the scattering toner deposited on the surface of the primary transfer roller 54 is transferred onto the inner peripheral surface of the intermediary transfer belt 56. Alternatively, the foreign matter deposited on the inner peripheral surface of the intermediary transfer belt 56 is not readily transferred onto the surface of the primary transfer roller 54. For this reason, the collection of the foreign matter can be made by the idler roller 61 with a high efficiency and on the surface of the primary transfer roller 54, the agglomeration-fixed matter does not readily grow. As a result, the occurrence of the image defect can be more reduced.

In Table 1 below, a scattering toner collection state with time with respect to each of combinations of the idler rollers 61 and the intermediary transfer belts 56 different in coefficient of static friction is shown.

TABLE 1

| | CSF*2 | FMDS*3 | |
|---|---|---|---|
| ID*1 | μ2 | ITB*A μ1:0.45 | ITB*B μ1/0.27 |
| A | 0.28 | x | ○Δ |
| B | 0.35 | x | ○ |

*1: "ID" represents the type of the idler roller.
*2: "CSF" represents the coefficient of static friction.
*3: "FMDS" represents a foreign matter deposition state with time.
*4: "ITB" represents the intermediary transfer belt.

As is apparent from Table 1, it is understood that between the coefficient of static friction μ2 of the surface of the idler roller 61 and the coefficient of static friction μ1 of the inner peripheral surface of the intermediary transfer belt 56, when a relationship of: μ1<μ2 is satisfied, the relationship is advantageous to collect the scattering toner with time.

Incidentally, in this embodiment, the relationship of the coefficient of static friction between the surface of the idler roller 61 and the inner peripheral surface of the intermediary transfer belt 56 is set but the surface of the another stretching roller may also be similarly set and such a stretching roller may be provided with the cleaning member. For example, a relationship between the surface of the idler roller 60 and the inner peripheral surface of the intermediary transfer belt 56 is set as described above, and the idler roller 60 is provided with the cleaning member. Incidentally, in this case, it is preferable that the winding angle of the intermediary transfer belt 56 about the idler roller 60 is ensured by, e.g., increasing a diameter of the idler roller 60 shown in FIG. 1.

Second Embodiment

A Second Embodiment of the present invention will be described with reference to FIGS. 5 to 9. In this embodiment, a lateral deviation (lateral shift) control device 80 as a lateral deviation control means for effecting lateral deviation control (meandering correction control) of the intermediary transfer belt 56 with respect to the widthwise direction which is a direction perpendicular to the rotational direction of the intermediary transfer belt 56 is provided. The lateral deviation control device 80 is disposed so as to contact the inner peripheral surface of the intermediary transfer belt 56 and includes a steering roller 61*a* for stretching the intermediary transfer belt 56. In this embodiment, the stretching roller located between the primary transfer portion T1 and the secondary transfer portion T2 (FIG. 1) is used as the steering roller 61*a*.

Further, by changing an inclination angle of the steering roller 61*a* with respect to the widthwise direction of the intermediary transfer belt 56 crossing the rotational direction of the intermediary transfer belt 56, the control of the lateral deviation of the intermediary transfer belt 56 with respect to the widthwise direction is effected. This control will be described.

[Lateral Deviation Control of Intermediary Transfer Belt]

The lateral deviation control device (movement control device) 80 includes the above-described steering roller 61*a*, a controller 81, a swinging motor 82 and end portion detecting sensors 83 and 84 as shown in FIG. 5. The steering roller 61*a* is, as shown in FIG. 6, supported swingably in an arrow direction in the figure with its one end (the right-hand end in the figure) as a supporting point. This swing direction is, as shown in FIG. 5, a direction substantially parallel to a plane of the intermediary transfer belt 56 opposing the respective photosensitive drums (FIG. 1). Incidentally, the swing-supporting point of the steering roller 61*a* may also be a central portion.

The controller 81 controls the swinging motor 82 to tilt the steering roller 61*a*, thus effecting the lateral deviation control to position the intermediary transfer belt 56 with respect to the widthwise direction. The swing motor 82 rotates, by a command from the controller 81, a cam of a cam mechanism between itself and the other end portion (the upper end portion in FIG. 5 and the left-hand end portion in FIG. 6) of the steering roller 61*a*. As a result, the other end portion of the steering roller 61*a* is moved, so that the steering roller 61*a* is swung as described above.

The other end portion of the steering roller 61*a* is urged toward the cam by an urging means such as a spring. That is, depending on a phase of the cam, the other end portion of the steering roller 61*a* is moved in a remote direction from the motor 82 and is moved toward the motor 82 by an urging force of the urging means generated by changing the phase of the cam. Incidentally, such a mechanism driven by the swinging motor 82 may also be, in addition to the cam mechanism, another mechanism such as a ball screw mechanism.

The end portion detecting sensors 83 and 84 are provided at limit positions of a normal lateral deviation control range of the intermediary transfer belt 56 and contact associated edges close to the limit positions, thus generating outputs at a plurality of levels depending on the position of the intermediary transfer belt 56 with respect to the widthwise direction. That is, the end portion detecting sensors 83 and 84 are disposed outside the both widthwise edges of the intermediary transfer belt 56 and by contact of the widthwise edge of the intermediary transfer belt 56 to the associated sensor, a signal is outputted to the controller 81 as indicated by an arrow of a chain line in FIG. 5.

In the lateral deviation of the intermediary transfer belt 56, on the basis of the output of the end portion detecting sensors 83 and 84, the angle of the steering roller 61*a* is adjusted. That is, the controller 81 detects the output of the end portion detecting sensors 83 and 84 to identify (discriminate) the position and the movement direction of the intermediary transfer belt 56 with respect to the widthwise direction and sends a command to the swinging motor as indicated by an arrow of a chain line in FIG. 5, thus changing the angle of the steering roller 61*a*. The steering roller 61*a* inverts the movement direction of the intermediary transfer belt 56 which is likely to deviate from the normal reciprocating movement direction (meandering control range) with respect to the widthwise direction, and then induces the intermediary transfer belt 51 toward its original widthwise center.

For example, when the controller 81 detects that the output from the lower-side end portion detecting sensor 84 in FIG. 5 corresponds to a preset position, the controller 81 actuates the swinging motor 82 to move the other end portion of the steering roller 61*a* in A direction in FIG. 5. Then, the intermediary transfer belt 56 moves in B direction in FIG. 5, so that the output of the end portion detecting sensor 84 is changed. Thereafter, when the end portion detecting sensor 83 detects a present position, the controller 81 actuates the swinging motor 82 to move the other end portion of the steering roller 61*a* in a direction opposite to the A direction. Then, the intermediary transfer belt 56 moves in a direction opposite to the B direction, so that the output of the end portion detecting sensor 83 is changed.

The controller 81 repeats such lateral deviation control of the intermediary transfer belt 56 to position the intermediary transfer belt 56, within the normal lateral deviation control range, movable in the widthwise direction (the axial direction of the a steering roller 61*a*), thus stably circulating the intermediary transfer belt 56.

Incidentally, in FIGS. 5 and 6, an inclination amount of the steering roller 61*a* and a movement latitude of the intermediary transfer belt 56 with respect to the intermediary transfer belt 56 are illustrated in an exaggerated manner. The control range in actual lateral deviation control of the intermediary transfer belt 56 is a range of about ±1.0 mm with respect to a reference position, and an inclination adjusting amount of the steering roller 61*a* by the swinging motor 82 is merely about ±0.5 mm. Further, on the basis of the end portion detecting sensors 83 and 84, when the inversion of the widthwise movement of the intermediary transfer belt 56 is identified, the controller 81 suppresses an increase in widthwise moving speed after the inversion by decreasing the inclination amount of the steering roller 61*a*. For this reason, in actually, the intermediary transfer belt 56 slowly reciprocates in the widthwise direction with, e.g., a period of 10-30 sec and an amplitude of 2 mm, so that the intermediary transfer belt 56 can be regarded as being stopped at a substantially constant position with respect to the widthwise direction in an image forming period of about 10 sheets.

In this embodiment, the above-described control is effected during image formation. Further, during non-image formation such as during pre-rotation, control such that the period of the lateral deviation control is made shorter than that during image formation is effected. In addition, during non-image formation, the control such that the amplitude of the lateral deviation control is made larger than that during image formation is effected. That is, during non-image formation, by switching the amplitude and the period in the lateral deviation control of the intermediary transfer belt 56, the intermediary transfer belt 56 is reciprocated in the widthwise direction with a large amplitude and with a short period. This will be described below.

[Operation of Intermediary Transfer Belt During Non-Image Formation]

In this embodiment, as shown in FIG. 7, during non-image formation such as during the pre-rotation or during post-rotation, the amplitude of the lateral deviation amount of the belt by the steering roller 61*a* is made larger than that and the period of the lateral deviation control of the belt by the steering roller 61*a* is made shorter than that in the case of the lateral deviation control during the above-described normal lateral deviation control (e.g., during image formation).

Here, in order to increase the amplitude, a detection position of the end portion detecting sensor is changed. The amplitude may only be required to be larger than that during image formation but is set so as not to be excessively large to the extent that the amplitude constitutes a hindrance to the lateral deviation control.

On the other hand, in order to shorten the period, the inclination adjustment amount of the steering roller with respect to the lateral deviation amount is increased. For example, the intermediary transfer belt 56 is reciprocated in an amplitude direction with a short period of 1-2 sec.

The lateral deviation control executed by switching the amplitude and the period from those during image formation may be effected in all of or a part of non-image formation period. In FIG. 7, such lateral deviation control is effected in the first half of the non-image formation period. In order to stabilize the normal lateral deviation control subsequently performed during image formation, it is preferable that the lateral deviation control is switched to the normal lateral deviation control in midstream of the non-image formation period. That is, in a period of the latter half of the non-image formation period, the normal lateral deviation control may preferably be executed.

The time period in which the lateral deviation control executed by switching the amplitude and the period from those during image formation may also be changed in consideration of an operation time during image formation, the number of sheets subjected to the image formation, timing when an operation such as the pre-rotation or the post-rotation is performed, and the like. For example, there is a possibility that the foreign matter such as the scattering toner is deposited on the belt and the rollers in a large amount is higher during the post-rotation than during the pre-rotation, and therefore the time when the lateral deviation control is effected by switching the amplitude and the period is made longer during the post-rotation than during the pre-rotation. Further, the possibility that the foreign matter such as the scattering toner is deposited on the belt and the rollers in the large amount is higher in the case where the number of sheets subjected to image formation from the preceding lateral deviation control effected by switching the amplitude and the period, and therefore the time when the lateral deviation control is effected by switching the amplitude and period is made longer with an increase in the number of sheets subjected to the image formation.

Further, such control effected by switching the amplitude and the period may also be executed during every non-image formation or with an interval to some extent. A frequency of the execution of the lateral deviation control may preferably be increased with, e.g., a decrease in humidity detected by an environmental sensor, provided in the image forming apparatus, for detecting a temperature and the humidity. Incidentally, in the case where if a voltage is applied to the primary transfer roller in adjustment performed during non-image formation, the above-described control is executed after this voltage application is ended.

Incidentally, during non-image formation may also be a period of time, in which the image formation is not effected, other than during the pre-rotation in which a warm-up operation of respective portions is performed at the time of power on or during restore from a sleep state and other than during the post-rotation in which, e.g., cleaning of the photosensitive drum is effected after the end of the image formation. For example, in midstream of the image formation, the adjustment of respective portions is effected in some cases by once stopping the image formation. The above-described control may also be executed during a period in such cases, which is used as during non-image formation.

An example of a flow of the above-described control will be described with reference to FIG. 8. First, when a print job is inputted through an operating panel or network (S1), an operation of the image forming apparatus is started to start the pre-rotation (S2). Here, a controller 81 switches setting of the amplitude and the period of the steering roller to that during non-image formation (S3). During this switching period, the intermediary transfer belt 56 repeats reciprocation motion in the widthwise direction with a shorter period than that in the normal lateral deviation control. After completion of this operation, the controller 81 returns the amplitude and the period of the steering roller 61*a* to set values of the amplitude and the period in the normal lateral deviation control (during image formation) and then starts the normal lateral deviation control of the intermediary transfer belt 56 (S4). Thereafter, various control operations such as registration detection, patch detection and the like for timing adjustment for superposing the images of the respective image forming stations and density adjustment of the images, and the like are performed (S5), so that the image forming operation is started (S6). When the image forming operation is ended, the post-rotation is started (S7) and similarly as in the case of the pre-rotation, the controller 81 switches the amplitude and the period of the steering roller 61*a* (S8). After this operation is ended, the controller 81 returns the amplitude and the period of the steering roller 61*a* to set values in the normal lateral deviation control (S9). Thereafter, the various control operations are performed (S10) and then the operation of the image forming apparatus is stopped (S11).

Thus, the amplitude and the period in the lateral deviation control of the steering roller 61*a* are changed from those during image formation, so that as shown in (a) to (c) of FIG. 9, the intermediary transfer belt 56 and the primary transfer roller 54 are relatively moved with a short period in the widthwise direction of the intermediary transfer belt 56. Then, a shearing force acts between the inner peripheral surface of the intermediary transfer belt 56 and the surface of the primary transfer roller 54 with respect to the widthwise direction of the intermediary transfer belt 56.

As a result, an agglomeration of the foreign matter such as the scattering toner conveyed to the primary transfer portion in a state in which the agglomeration of the foreign matter is carried while being deposited on the inner peripheral surface of the intermediary transfer belt 56 is loosened by this shearing force. Then, the foreign matter is distributed so as to spread over the surface of the primary transfer roller 54 or the inner peripheral surface of the intermediary transfer belt 56, so that the agglomeration of the foreign matter is not readily present between the inner peripheral surface of the intermediary transfer belt 56 and the surface of the primary transfer roller 54. As a result, between these surfaces, a local gap and a resistance fluctuation are not readily generated, so that a degree of an occurrence of image defect can be reduced.

Incidentally, during non-image formation, the period in the lateral deviation control of the steering roller 61*a* may be made shorter than that during image formation while keeping the amplitude as it is. Also in this case, similarly as in the above-described case, the intermediary transfer belt 56 and the primary transfer roller 54 are relatively moved with a short period with respect to the widthwise direction of the intermediary transfer belt 56, so that the shearing force with respect to the widthwise direction acts between the intermediary transfer belt 56 and the primary transfer roller 54. Thus, the agglomeration of the foreign matter is not readily present between the inner peripheral surface of the intermediary transfer belt 56 and the surface of the primary transfer roller 54. However, as described above, the agglomeration of the foreign matter can be spread over a wide range when the amplitude is also increased, and therefore between the inner peripheral surface of the intermediary transfer belt 56 and the surface of the primary transfer roller 54, the agglomeration is not readily present further.

[Relationship of Coefficient of Static Friction Between Inner Peripheral Surface of Intermediary Transfer Belt and Surface of Steering Roller]

Further, in this embodiment, the relationship of the coefficient of static friction between the inner peripheral surface of the intermediary transfer belt 56 and the surface of the steering roller 61*a* is set as follows. That is, the relationship is set so that the coefficient of static friction of the surface of the steering roller 61*a* is larger than the coefficient of static friction of the inner peripheral surface of the intermediary transfer belt 56.

Figure 1:
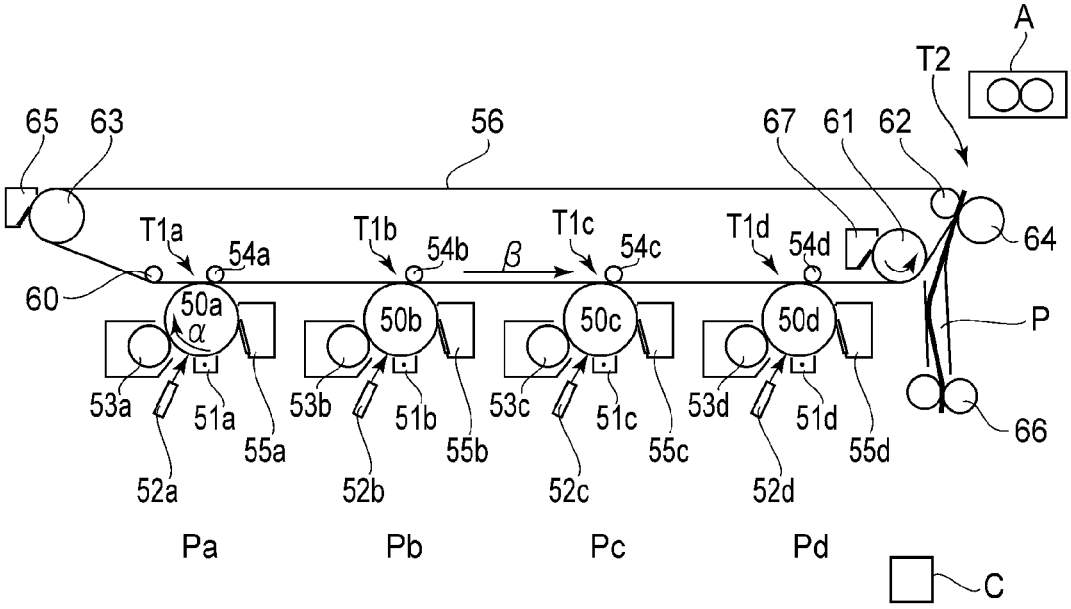
FIG. 1 is a schematic sectional vie of an image forming apparatus according to a First Embodiment of the present invention.

Further, similarly as in the above-described case of FIG. 1, the steering roller cleaning member for cleaning the surface of the steering roller 61*a* is disposed. The steering roller cleaning member is the same as the cleaning member 67 in FIG. 1. However, the steering roller cleaning member is configured so that its cleaning blade can follow inclination of the steering roller 61*a* by being fixedly supported by the rotation shaft of the steering roller 61*a*.

Thus, by making the coefficient of static friction of the surface of the steering roller 61*a* larger than the coefficient of static friction of the inner peripheral surface of the intermediary transfer belt 56, the foreign matter such as the scattering toner deposited on the inner peripheral surface of the intermediary transfer belt 56 is transferred onto the surface of the steering roller 61*a*. Alternatively, the foreign matter deposited on the surface of the steering roller 61*a* is not readily transferred onto the inner peripheral surface of the intermediary transfer belt 56. That is, a force of retaining the foreign matter is larger at the surface of the steering roller 61*a* and therefore the foreign matter between the steering roller 61*a* and the intermediary transfer belt 56 remains on the steering roller 61*a*. For this reason, the foreign matter deposited on the inner peripheral surface of the intermediary transfer belt 56 is easily transferred onto the surface of the steering roller 61*a* and is not readily transferred onto the inner peripheral surface of the intermediary transfer belt 56.

Therefore, the foreign matter deposited on the inner peripheral surface of the intermediary transfer belt 56 is transferred onto the surface of the steering roller 61*a* and is removed and collected by the steering roller cleaning member. That is, in this embodiment, the steering roller 61*a* has the same function as the idler roller 61 in the First Embodiment.

Incidentally, also in this embodiment, similarly as in the above-described First Embodiment, it is preferable that the coefficient of static friction of the inner peripheral surface of the intermediary transfer belt 56 is larger than the coefficient of static friction of the surface of the primary transfer roller 54. As a result, the foreign matter deposited on the surface of the primary transfer roller 54 is transferred onto the inner peripheral surface of the intermediary transfer belt 56, and the foreign matter deposited on the inner peripheral surface of the intermediary transfer belt 56 is conveyed to the steering roller 61*a* without being transferred onto the surface of the primary transfer roller 54. Then, as described above, the foreign matter is transferred onto the steering roller 61*a* and then is removed and collected by the steering roller cleaning member. As a result, it is possible to reduce a degree of growth of the foreign matter such as the toner into the agglomeration-fixed matter on the inner peripheral surface of the intermediary transfer belt 56 or the surface of the primary transfer roller 54.

According to this embodiment, as described above, during non-image formation, the amplitude and the period in the lateral deviation control of the steering roller 61*a* are switched and therefore the agglomeration of the foreign matter is not readily present between the surface of the primary transfer roller 54 and the inner peripheral surface of the intermediary transfer belt 56. Further, the relationships of the coefficient of static friction between the surface of the steering roller 61*a* and the inner peripheral surface of the intermediary transfer belt 56 and between the inner peripheral surface of the intermediary transfer belt 56 and the surface of the primary transfer roller 54 are set as described above, so that the foreign matter can be collected on the surface of the steering roller 61*a*. Then, the foreign matter can be removed and collected by the steering roller cleaning member. As a result, the local gap and the fluctuation in resistance are not readily generated between the surface of the primary transfer roller 54 and the intermediary transfer belt 56, so that the degree of occurrence of the image defect can be reduced. Other constitutions and actions are the same as those in the above-described First Embodiment.

Other Embodiments

The above-described embodiments can be executed appropriately in combination. For example, the lateral deviation control of the steering roller may also be effected as in the Second Embodiment and in addition, the coefficient of static friction of the surface of the stretching roller other than the steering roller is made larger than that of the inner peripheral surface of the intermediary transfer belt, and the cleaning member may also be provided to the stretching roller.

Further, in the above-described embodiments, the structure of the tandem type is described but the present invention is also applicable to an image forming apparatus of a so-called one drum type in which a plurality of developing devices for different colors are supported by a rotatable member and toner images are successively formed on a single photosensitive drum. Further, the present invention is also applicable to an image forming apparatus using a monochromatic toner, in addition to the image forming apparatus using the toners of the plurality of colors.

Further, in the above-described embodiments, the case where the present invention is applied to the intermediary transfer type using the intermediary transfer belt is described but the present invention is also applicable to a direct transfer type in which a recording material conveyance belt for directly transferring the photosensitive drum onto the recording material is provided. That is, the present invention can be similarly carried out by replacing the intermediary transfer belt with the recording material conveyance belt.

For example, the recording material conveyance belt which is the endless belt opposing the photosensitive drum as the image bearing member is disposed opposed to the photosensitive drum. This recording material conveyance roller is, similarly as in the above-described embodiments, stretched and rotationally driven by the plurality of stretching rollers. In such a constitution, the coefficient of static friction of the surface of any of the stretching rollers is made larger than that of the inner peripheral surface of the recording material conveyance belt, and the cleaning member is provided to the stretching roller. Alternatively, the period in the lateral deviation control of the steering roller for effecting the lateral deviation control of the recording material conveyance belt is made shorter during non-image formation than during image formation. Further, the amplitude of the steering roller in the lateral deviation control is made larger during non-image formation than during image formation. Further, the coefficient of static friction of the surface of the transfer roller for transferring the toner image from the photosensitive drum onto the recording material conveyed by the recording material conveyance belt is made smaller than the coefficient of static friction of the inner peripheral surface of the recording material conveyance belt.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 173527/2011 filed Aug. 9, 2011, which is hereby incorporated by reference.

What is claimed is:

1. An image forming apparatus comprising:

a plurality of photosensitive drums configured to bear a toner image;

a rotatable endless belt provided so that its outer peripheral surface opposes said photosensitive drums;

a plurality of rigid transfer rollers, provided at positions corresponding to the photosensitive drums, respectively, so as to contact an inner peripheral surface of said belt, configured to transfer the toner image from said photosensitive drum onto said belt or a recording material conveyed by said belt by being supplied with a transfer bias, wherein a coefficient of static friction of a surface of said transfer roller contacting the inner peripheral surface of said belt is smaller than a coefficient of static friction of the inner peripheral surface of said belt;

a cleaning roller, provided adjacent to and downstream of a downstream-most photosensitive drum of said photosensitive drums with respect to a rotational direction of said belt so as to contact the inner peripheral surface of said belt to clean said belt, wherein a coefficient of static friction of a surface of said cleaning roller contacting the inner peripheral surface of said belt is larger than the coefficient of static friction of the inner peripheral surface of said belt;

a cleaning member configured to clean the surface of said cleaning roller; and a movement control portion configured to control movement of said belt in a widthwise direction so that a reciprocating movement time of said belt with respect to the widthwise direction during non-image formation is shorter than that during image formation.

2. The image forming apparatus according to claim 1, wherein said movement control portion controls a movement distance of said belt with respect to the widthwise direction during non-image formation so as to be larger than that during image formation.

3. The image forming apparatus according to claim 2, wherein said transfer roller is shifted and disposed downstream of said photosensitive drum with respect to a rotational direction of said belt, and wherein when in a plane perpendicular to a rotational axis of said photosensitive drum, a radius of said photosensitive drum is R, a radius of said transfer roller is r, a center distance between said photosensitive drum and said transfer roller is d, and a thickness of said belt is sufficiently smaller than (R+r), a relationship of: d>(R+r) is satisfied.

4. An image forming apparatus comprising:

a photosensitive drum for bearing a toner image;

a rotatable endless belt provided so that its outer peripheral surface opposes said photosensitive drum;

a rigid transfer roller, provided so as to contact an inner peripheral surface of said belt, configured to transfer the toner image from said photosensitive drum onto said belt or a recording material conveyed by said belt by being supplied with a transfer bias; and a movement control portion configured to control movement of said belt so that a reciprocating movement time of said belt with respect to a widthwise direction of said belt direction during non-image formation is shorter than that during image formation.

5. The image forming apparatus according to claim 4, wherein said movement control portion controls a movement distance of said belt with respect to the widthwise direction during non-image formation so as to be larger than that during image formation.

6. The image forming apparatus according to claim 5, wherein said movement control portion comprises a steering roller, provided so as to contact the inner peripheral surface of said belt, configured to stretch said belt and control the movement of said belt with respect to the widthwise direction by changing an inclination angle of said steering roller with respect to a rotational axis of said photosensitive drum, wherein said image forming apparatus further comprises a steering roller cleaning member for cleaning a surface of said steering roller, and wherein a coefficient of static friction of a surface of said steering roller contacting the inner peripheral surface of said belt is larger than a coefficient of static friction of the inner peripheral surface of said belt.

7. The image forming apparatus according to claim 6, wherein said transfer roller is shifted and disposed downstream of said photosensitive drum with respect to a rotational direction of said belt, and wherein when in a plane perpendicular to a rotational axis of said photosensitive drum, a radius of said photosensitive drum is R, a radius of said transfer roller is r, a center distance between said photosensitive drum and said transfer roller is d, and a thickness of said belt is sufficiently smaller than (R+r), a relationship of: d>(R+r) is satisfied.

* * * * *